US010399763B2

(12) United States Patent
Kang

(10) Patent No.: US 10,399,763 B2
(45) Date of Patent: Sep. 3, 2019

(54) GEL FOUNDATION CONTAINER COMPRISING PUMP

(71) Applicant: Sungil Kang, Seongnam-si (KR)

(72) Inventor: Sungil Kang, Seongnam-si (KR)

( * ) Notice: Subject to any disclaimer, the term of this patent is extended or adjusted under 35 U.S.C. 154(b) by 197 days.

(21) Appl. No.: 15/507,570

(22) PCT Filed: Sep. 7, 2015

(86) PCT No.: PCT/KR2015/009435
§ 371 (c)(1),
(2) Date: Feb. 28, 2017

(87) PCT Pub. No.: WO2016/036229
PCT Pub. Date: Mar. 10, 2016

(65) Prior Publication Data

US 2017/0305642 A1 Oct. 26, 2017

(30) Foreign Application Priority Data

Sep. 5, 2014 (KR) ..... 20-2014-0006587 U

(51) Int. Cl.
*A45D 34/00* (2006.01)
*A45D 34/04* (2006.01)
(Continued)

(52) U.S. Cl.
CPC ..... *B65D 83/005* (2013.01); *A45D 34/00* (2013.01); *A45D 34/04* (2013.01); *A45D 40/00* (2013.01);
(Continued)

(58) Field of Classification Search
CPC ..... A45D 33/34; A45D 33/006; A45D 33/06; A45D 33/003; A45D 33/02; A45D 33/025;
(Continued)

(56) References Cited

U.S. PATENT DOCUMENTS 344,447 A * 6/1886 Johnston ..... B65D 83/0005 222/386
1,001,771 A * 8/1911 Roehrig ..... A45D 33/006 132/298
(Continued)

FOREIGN PATENT DOCUMENTS

KR 10-0841441 B1 6/2008
KR 10-2010-0128968 A 12/2010
(Continued)

*Primary Examiner* — Patrick M. Buechner
(74) *Attorney, Agent, or Firm* — Heedong Chae; Lucem, PC

(57) ABSTRACT

A gel foundation container including a pump, the gel foundation container further including content discharge grooves radially formed on a distribution plate; second control protrusions, which are formed inside the content discharge grooves, for controlling the flow of content; a discharge plate formed at the upper end of the distribution plate; and content discharge holes radially formed at the discharge plate at the same position as the content discharge grooves of the distribution plate, wherein the content discharge holes are formed so as to gradually become larger outwardly from the center of the discharge plate, and thus gel foundation is equally discharged in the same amount onto the entire discharge plate when being pumped.

10 Claims, 8 Drawing Sheets

(51) Int. Cl.

| | |
|---|---|
| ***A45D 40/00*** | (2006.01) |
| ***A45D 40/22*** | (2006.01) |
| ***A45D 40/26*** | (2006.01) |
| ***B05B 11/00*** | (2006.01) |
| ***B65D 83/00*** | (2006.01) |

(52) U.S. Cl.
CPC ..... *A45D 40/222* (2013.01); *A45D 40/26* (2013.01); *B05B 11/3001* (2013.01); *B05B 11/3046* (2013.01); *A45D 2040/223* (2013.01); *A45D 2200/055* (2013.01); *A45D 2200/056* (2013.01); *A45D 2200/1009* (2013.01)

(58) Field of Classification Search
CPC .... A45D 33/16; A45D 40/0075; A45D 40/22; A45D 2200/056; A45D 2200/052; B65D 83/0005; B65D 83/0033; B65D 83/0055; B65D 83/0072; B05B 11/0037; B05B 11/0038; B05B 11/0039; B05B 11/0041; B05B 11/00412; B05B 11/0062; B05B 11/007; B05B 11/02; B05B 11/30; B05B 11/3001
USPC ..... 401/130, 188 R
See application file for complete search history.

(56) References Cited

U.S. PATENT DOCUMENTS

| | | | | |
|---|---|---|---|---|
| 2016/0015149 | A1* | 1/2016 | Kim | A45D 34/00 222/383.1 |
| 2016/0242529 | A1* | 8/2016 | Oh | A45D 34/00 |
| 2016/0303601 | A1* | 10/2016 | Kang | A45D 34/00 |
| 2017/0347772 | A1* | 12/2017 | Kang | A45D 34/00 |
| 2017/0354230 | A1* | 12/2017 | Oh | A45D 34/00 |
| 2018/0228266 | A1* | 8/2018 | Caulier | A45D 33/003 |

FOREIGN PATENT DOCUMENTS

| | | | |
|---|---|---|---|
| KR | 10-1103188 | B1 | 1/2012 |
| KR | 20-0470757 | Y1 | 1/2014 |
| KR | 10-1390993 | B1 | 5/2014 |

* cited by examiner

Prior Art

Prior Art

GEL FOUNDATION CONTAINER COMPRISING PUMP

CROSS-REFERENCE TO RELATED APPLICATION

This application claims the benefit of Korean application No. 20-2014-0006587, filed on Sep. 5, 2014 with the Korean Intellectual Property Office, the disclosure of which is incorporated herein by reference.

TECHNICAL FIELD

The present invention relates to a gel foundation container comprising a pump and, more specifically, to a gel foundation container with a pump, which includes content discharge grooves radially formed on a distribution plate, second control protrusions formed inside the content discharge grooves to control the flow of contents; a discharge plate formed on an upper end of the distribution plate, and content discharge holes radially formed on the discharge plate at the same positions as the content discharge grooves of the distribution plate, wherein the content discharge holes are formed so as to gradually become larger outwardly from the center of the discharge plate, and thus gel foundation is equally discharged in the same amount onto the entire discharge plate when being pumped, thereby allowing a cosmetic material to be applied without becoming cakey when the foundation is applied to the skin by using a puff.

BACKGROUND ART

Color cosmetics, which are used to beautifully adorn the skin of a user by making the appearance beautiful, are classified into a base makeup used for making a skin color uniform and capping a defect and a point makeup used for partially enhancing a three-dimensional effect of a lip, eyes, or nails. The base makeup includes a makeup base, a foundation and a powder, and the point makeup includes a lipstick, an eye liner, and mascara.

The foundation is classified into solid-type foundation, liquid-type foundation and gel-type foundation according to a type of cosmetic contents. In case of the solid-type foundation, although the solid-type foundation has a good cover effect, the makeup is united when the makeup is refreshed. In case of the liquid-type foundation, although the liquid-type foundation gives a good close contact feel, the persistency is weak. Thus, in recent years, the number of customers favoring the gel-type foundation having a considerable persistency and a good close contact feel has been increased.

Therefore, there is a need to develop a container for gel-type foundation. In general, the gel-type foundation, which is filled into a glass container or a tub-type container, is used in such a manner that a user takes some foundation on his hands for use or squeezes foundation from the container and then, applies the foundation on his skin by using a puff or his hands.

However, according to the related art, since a user gets cosmetics on his hands every time that the cosmetics are used, it is inconvenient to wash hands every time after use.

To solve the above problems, as shown in FIG. 1, a compact container having an airless pump is disclosed in Korean Registered Utility Model No. 20-0470757 issued to the applicant of the present application. According to the related art, as a mixing member is pressed, a distribution plate and a pump are pressed, so that the cosmetics filled in a container body are discharged onto the distribution plate. Then, a user uses the cosmetics impregnated to the mixing member by getting a puff the cosmetics for makeup, so that the cosmetic can be used without coating user's hands with the cosmetics.

However, the airless puma 110 use in the related art includes a piston 111, a cylinder 112 into which the piston 111 is inserted, a piston ring 113 installed between the outer peripheral surface of the piston 111 and the inner peripheral surface of the cylinder 112, a check valve 114 formed on a lower portion of the cylinder 112, a sealing member 115 coupled to an upper portion of the cylinder 3, an elevating member 116 coupled to at inside of the sealing member 115, and an elastic member 117 formed between the elevating member 116 and the sealing member 115. Since the airless pump is assembled using a plurality of components, the manufacturing cost thereof is increased. In addition, since the components are assembled with each other, the number of the assembling processes is increased, so that the productivity is deteriorated.

In addition, according to the related art, the discharge hole 118 of the pump 110 is formed on the central portion and the plurality of distribution holes 130 are formed on the distribution plate 120 at a predetermined size, a large amount of cosmetics are distributed through the distribution holes 130 at the central portion. Thus, when the distribution plate 120 fails to exhibit its function, the cosmetic material is not uniformly distributed to the mixing member 140, so that the cosmetic material is aggregated when applied to the skin by using a puff.

To solve the above-described problems, as shown in FIG. 2, the present applicant had field a pump having a short stroke and a foundation container having a contents diffusion member in Korean Utility Model Application No. 20-2013-0007876. According to the application, the suction valve plate 211, the discharge valve 212 and the elastic member 213 are formed to simplify the structure of the pump 210. The volume of the content temporary storage 220 is changed by moving the pump upper body 214 mounted with the discharge valve 212 up and down in the pump main body 215, so that the stroke distance of the pump is reduced. In addition, a content diffusion member 230 is provided on the upper end of the pump upper body 214 to uniformly spread the cosmetic material on the impregnation member 240 and is applied to the skin by using a puff.

However, according to the related art, the diffusion member 230 is formed with a flow channel having a constant thickness and the content outlet 216 of the pump is located only in the central portion, so that a large amount of cosmetic materials are discharged to the central portion and is not uniformly diffused to the infiltration member. Thus, when the cosmetic material is applied to the skin by using a puff, there is still a problem that cosmetic materials are aggregated.

In addition, since the impregnation member 240 is exposed when using cosmetics, the cosmetics are contaminated and the moisture evaporated to dry the cosmetics, so that the function of the cosmetics may not be exerted.

DISCLOSURE

Technical Problem

To solve the problems described above, an object of the present invention is to provide a gel foundation container with a pump, which includes content discharge grooves radially formed on a distribution plate, second control protrusions formed inside the content discharge grooves to control the flow of contents; a discharge plate formed on an upper end of the distribution plate, and content discharge holes radially formed on the discharge plate at the same positions as the content discharge grooves of the distribution plate, wherein the content discharge holes are formed so as to gradually become larger outwardly from the center of the discharge plate, and thus gel foundation is equally discharged in the same amount onto the entire discharge plate when being pumped, thereby allowing a cosmetic material to be applied without becoming cakey when the foundation is applied to the skin by using a puff.

Another object of the present invention is to provide a gel foundation container with a pump, where a first content control protrusion is formed on an upper end of a valve fixing member and a second content control protrusion is formed on an upper end of a distribution plate to control a speed at which cosmetics are distributed in an pumping operation, so that the cosmetics may be uniformly distributed to the whole of a content discharge groove of the distribution plate.

Still another object of the present invention is to provide a gel foundation container with a pump, which is capable of preventing the cosmetic material contained in a content container from being contaminated by forming a content discharge hole on a discharge plate so that the cosmetic material is prevented from making contact with air, thereby using cleanly and hygienically the gel foundation container for a long time.

Technical Solution

According to the present invention, there is provided a gel foundation container with a pump, which includes an outer container (10) and an outer container lid (20) hinge-coupled to the outer container (10) so as to be opened or closed. The gel foundation container includes:

a container body (30) installed inside the outer container (10);

a pump (50) coupled to an upper portion of the container body (30); and a discharge plate (60) coupled to an upper portion of the pump (50) and formed with a content discharge hole (61), wherein the pump (50) includes a pump bottom plate (51) formed at a center thereof with a content inlet (511), a pump main body (52) installed on the pump bottom plate (51), an elastic member (53) installed between the pump bottom plate (51) and the pump main body (52), the distribution plate (54) coupled at an upper side of the pump main body (52) such that the distribution plate (54) is movable up or down, and formed with a content outlet (542), a discharge valve (55) installed on the distribution plate (54), the valve fixing member (56) for fixing the discharge valve (55), a pump body (521) formed at a center of the pump main body (52), and a suction valve (523) formed on an inner low portion of the pump body (521) and connected to an elastic piece (522), wherein the distribution plate (54) is radially formed thereon with content discharge grooves (547), and second control protrusions (548) are formed in the content discharge grooves (547), wherein first control protrusions (562) are formed on the valve fixing member (56), and wherein the second control protrusions (548) are formed outside the first control protrusions (562).

In addition, a content container (40) formed of a thin material which is easily deformable is installed in the container main body (30).

In addition, the gel foundation container further includes a sponge (45) installed in the content container (40).

In addition, the gel foundation container further includes a latch sill (41) formed on the content container (40).

In addition, the pump body (521) is formed at a center of the pump main body (52), and the suction valve (523) is formed on an inner low portion of the pump body (521) and connected to an elastic piece (522).

In addition, the pump body (521) is formed on an outer low portion thereof with a low side extension piece (524) and on an outer upper portion thereof with an upper side extension piece (525).

In addition, a discharge valve protrusion wheel (543) is formed at a center of the distribution plate (54), a discharge outlet (542) is formed on a side surface of the discharge valve protrusion wheel (543), and a valve installation space (541) is formed near the discharge valve protrusion wheel (543).

In addition, the discharge valve (55) is formed with a discharge valve wing (551).

In addition, the valve fixing member (56) is formed at a center thereof with a content discharge hole (561).

In addition, sizes of the content discharge holes (61) of the discharge plate (60) gradually become larger outwardly from a center of the discharge plate (60).

Advantageous Effects

According to the present invention, the gel foundation container with a pump, which includes content discharge grooves radially formed on a distribution plate, second control protrusions formed inside the content discharge grooves to control the flow of contents; a discharge plate formed on an upper end of the distribution plate, and content discharge holes radially formed on the discharge plate at the same positions as the content discharge grooves of the distribution plate, wherein the content discharge holes are formed so as to gradually become larger outwardly from the center of the discharge plate, and thus gel foundation is equally discharged in the same amount onto the entire discharge plate when being pumped, thereby allowing a cosmetic material to be applied without becoming cakey when the foundation is applied to the skin by using a puff.

In addition, the present invention provides a gel foundation container with a pump, where a first content control protrusion is formed on an upper end of a valve fixing member and a second content control protrusion is formed on an upper end of a distribution plate to control a speed at which cosmetics are distributed in an pumping operation, so that the cosmetics may be uniformly distributed to the whole of content discharge groove of the distribution plate.

In addition, according to the present invention, the cosmetic material contained in a content container is prevented from being contaminated by forming a content discharge hole on discharge plate, so that the cosmetic material is prevented from making contact with air, thereby using cleanly and hygienically the gel foundation container for a long time.

BEST MODE

Mode for Invention

Hereinafter, gel foundation container with a pump according to an embodiment of the present invention will be described with reference to accompanying drawings.

Figure 1:
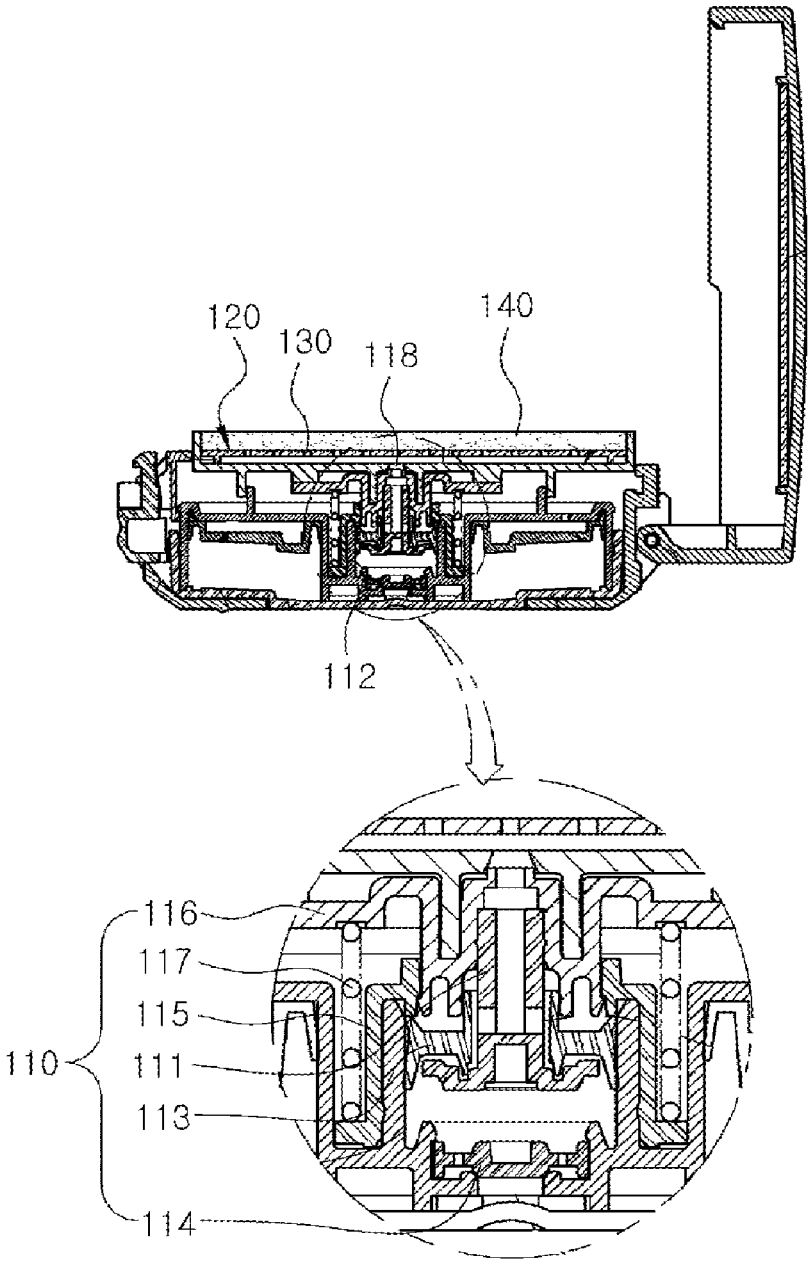
FIG. 1 is a sectional view showing a compact container having an airless pump according to the related art.
Figure 2:
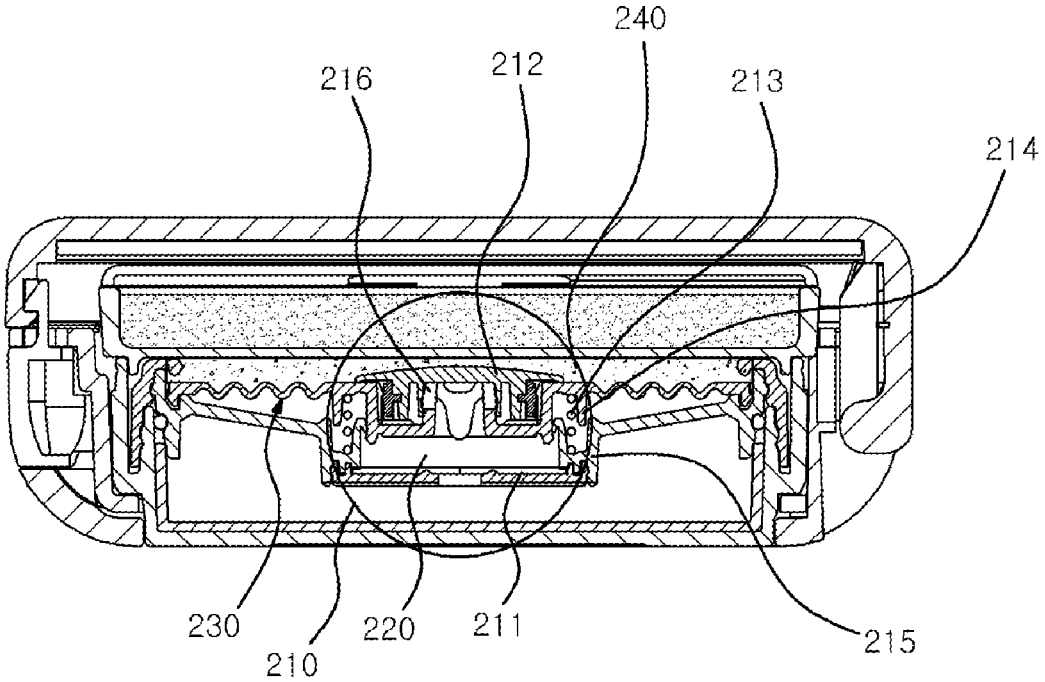
FIG. 2 is a sectional view showing a foundation container having a pump having a short stroke distance and a content diffusion member according to the related art.
Figure 3:
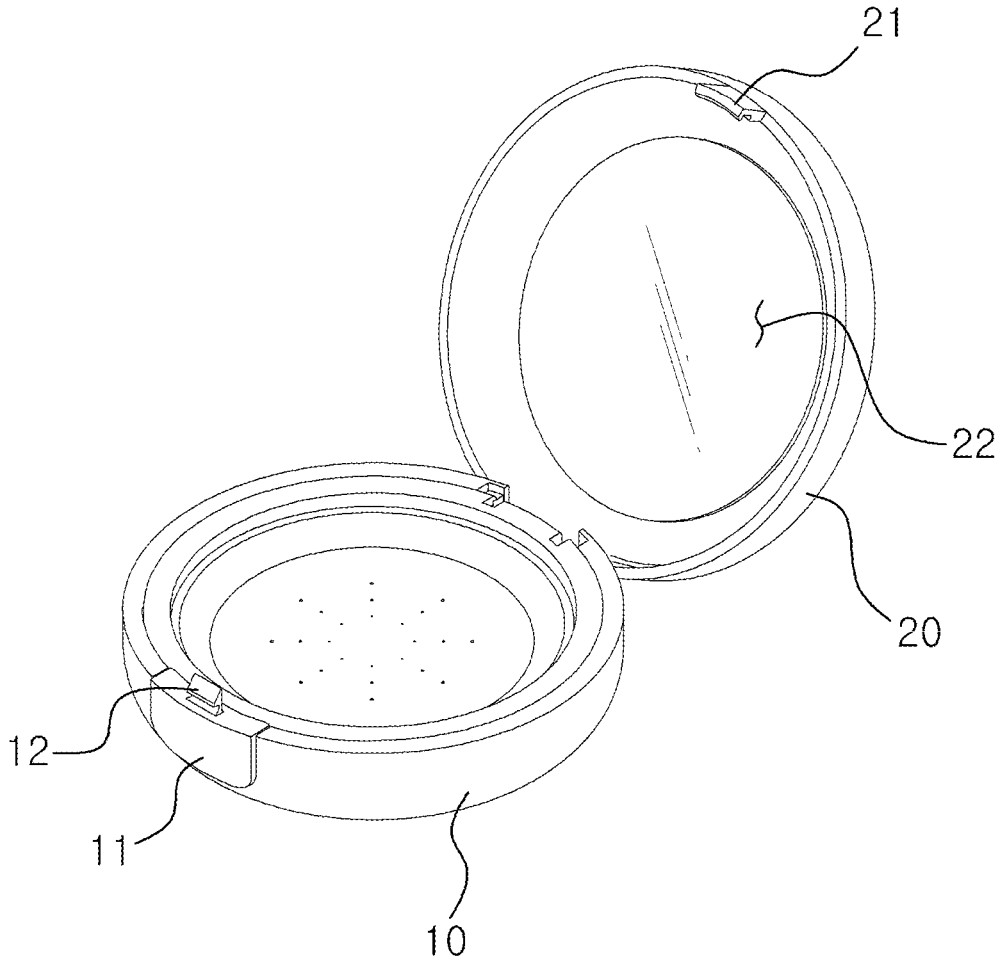
FIG. 3 is a perspective view showing a state that the outer container lid of a gel foundation container with a pump is opened according to an embodiment of the present invention.
Figure 4:
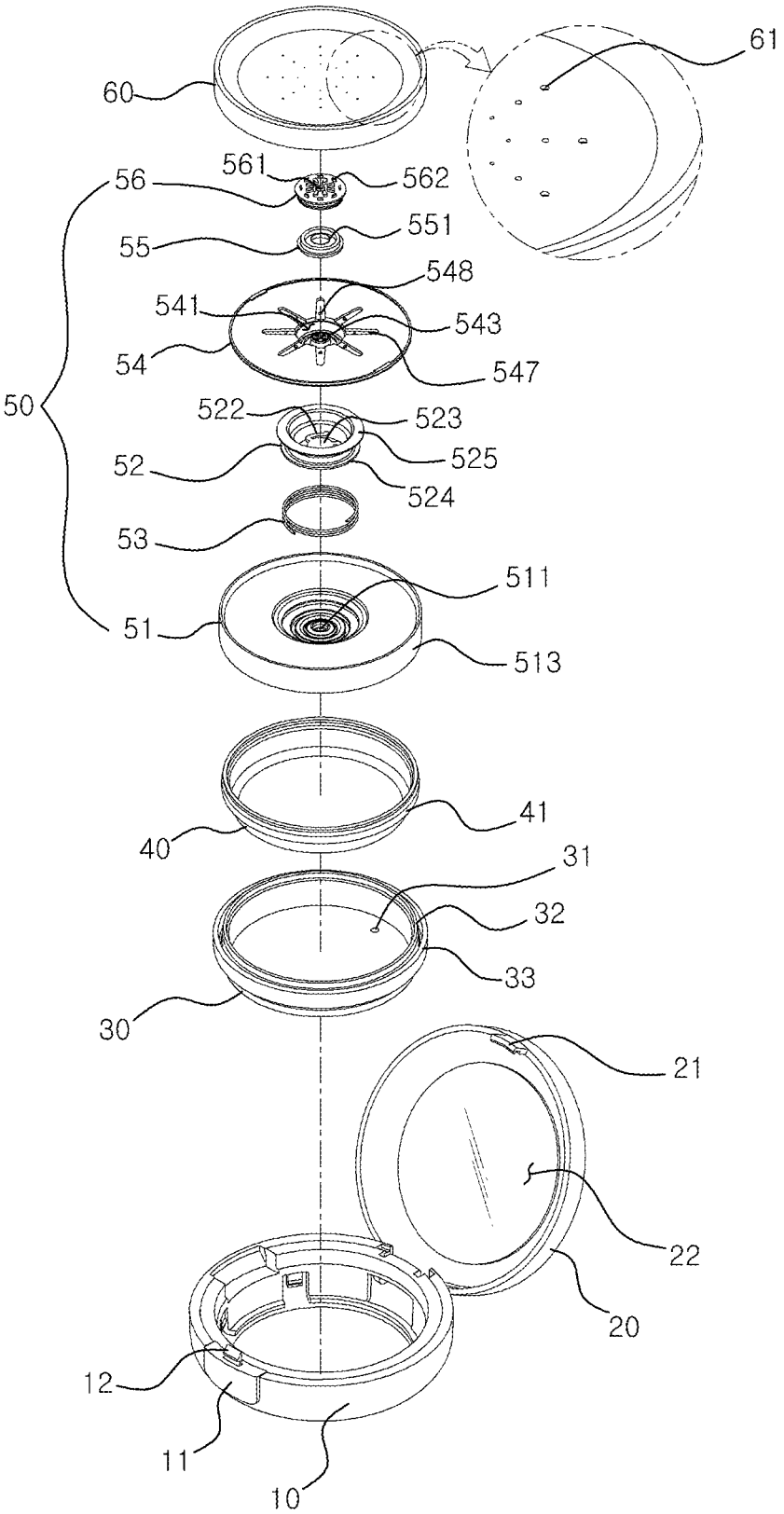
FIG. 4 is an exploded perspective view showing a gel foundation container with a pump according to an embodiment of the present invention.
Figure 5:
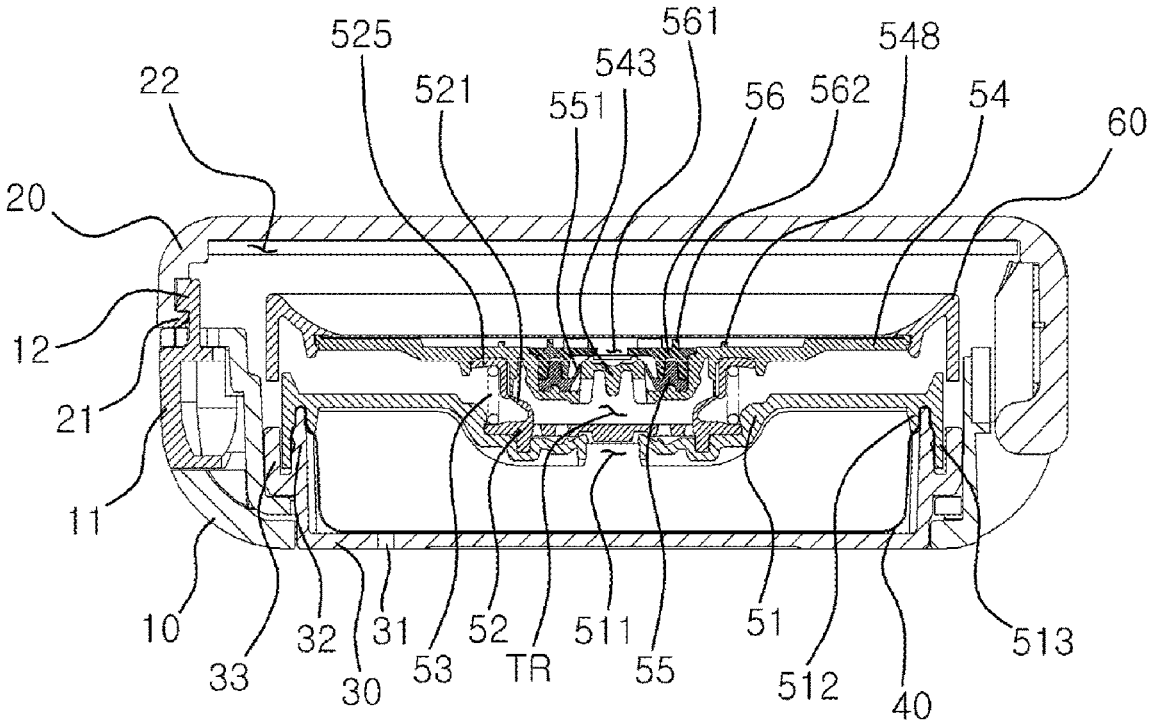
FIG. 5 is a sectional view showing a gel foundation container with a pump according to an embodiment of the present invention.
Figure 6:
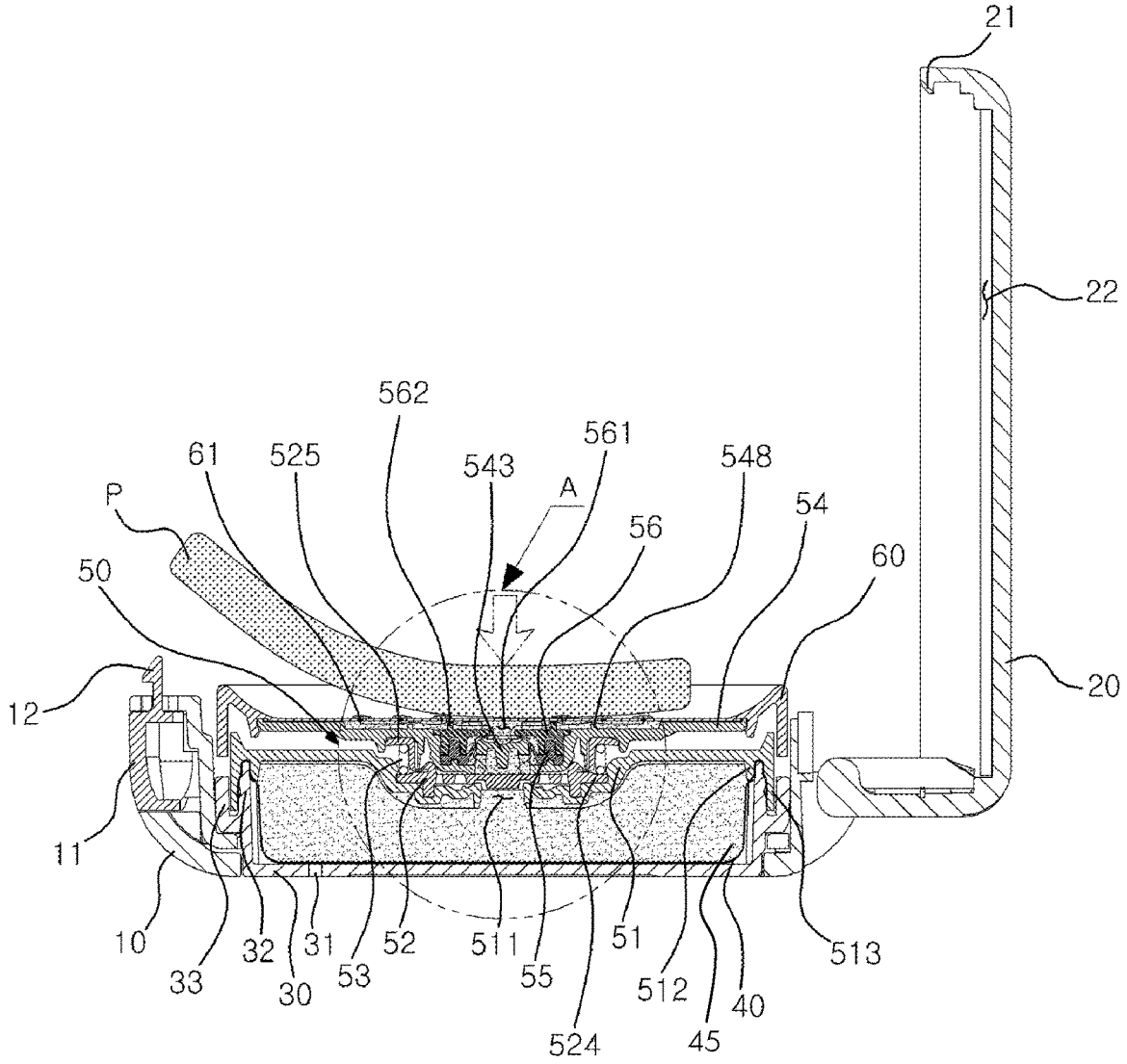
FIG. 6 is a sectional view showing a stat that the discharge plate of gel foundation container with a pump is pressed according to an embodiment of the present invention.
Figure 7:
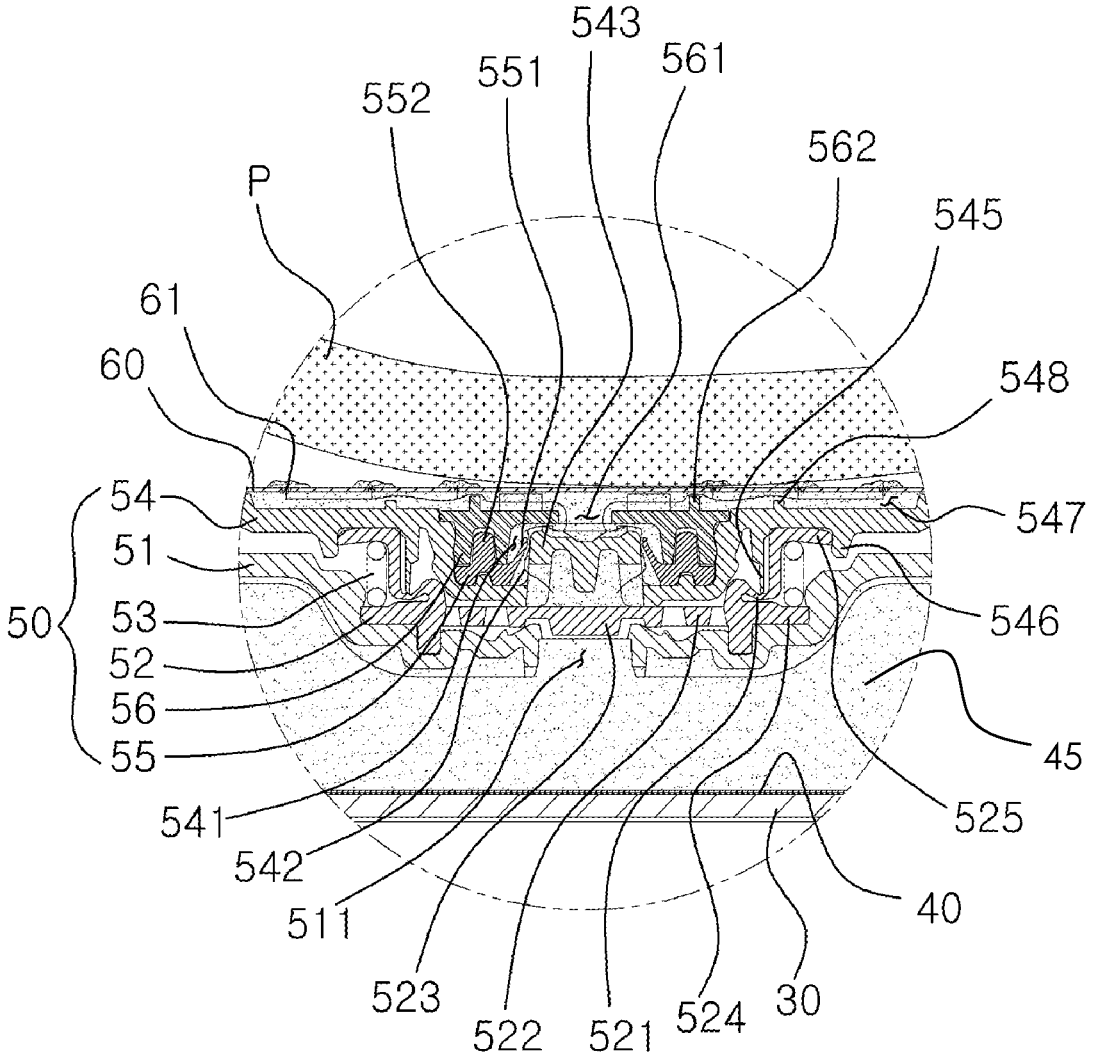
FIG. 7 is an enlarged view of part A of FIG. 6.
Figure 8:
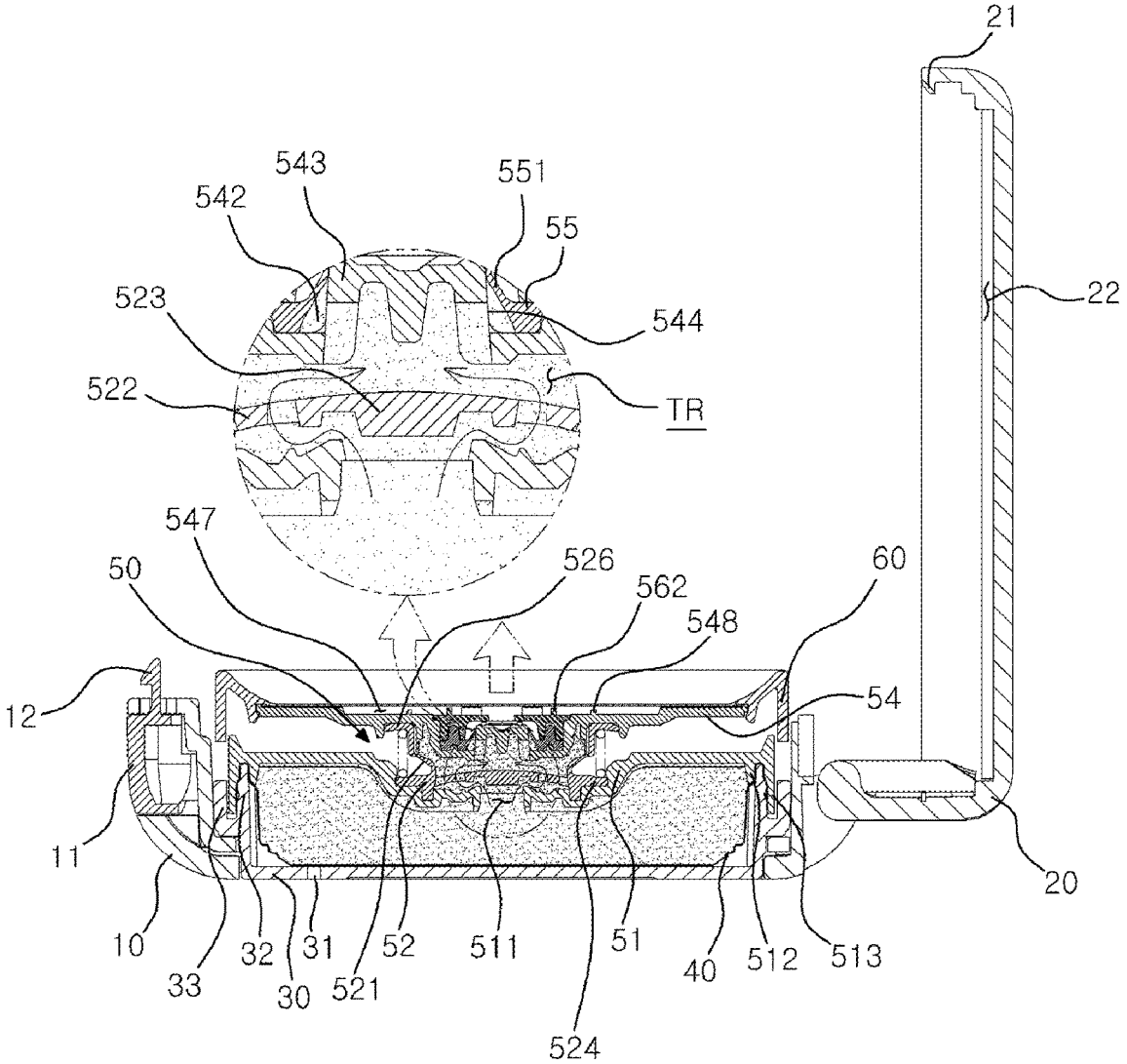
FIG. 8 is a sectional view showing a stat that the pressure on the discharge plate of a gel foundation container with a pump is released according to an embodiment of the present invention.

FIG. 3 is a perspective view showing a state that the outer container lid of a gel foundation container with a pump s opened according to an embodiment of the present invention. FIG. 4 is an exploded perspective view showing a gel foundation container with a pump according to an embodiment of the present invention. FIG. 5 is a sectional view showing a gel foundation container with a pump according to an embodiment of the present invention. FIG. 6 is a sectional view showing a stat that the discharge plate of a gel foundation container with a pump is pressed according to an embodiment of the present invention. FIG. 7 is an enlarged view of part A of FIG. 6. FIG. 8 is a sectional view showing a stat that the pressure on the discharge plate of a gel foundation container with a pump is released according to an embodiment of the present invention.

According to the present invention, there is provided a gel foundation container with a pump, which includes an outer container 10 and an outer container lid 20 hinge-coupled to the outer container to be opened or closed. The gel foundation container with a pump includes a container body 30 installed inside the outer container 10, a pump 50 coupled to an upper portion of the container body 30, and a discharge plate 60 coupled to an upper portion of the pump 50 and formed with a content discharge hole 61, wherein the pump 50 includes a pump bottom plate 51 formed at a center thereof with a content inlet 511, a pump main body 52 installed on the pump bottom plate 51, an elastic member 53 installed between the pump bottom plate 51 and the pump main body 52, the distribution plate 54 coupled at an upper side of the pump main body 52 to be movable up or down and formed with a content outlet 542, a discharge valve 55 installed on the distribution plate 54, the valve fixing member 56 for fixing the discharge valve 55, the distribution plate 54 is radially formed thereon with content discharge grooves 547, wherein second control protrusions 548 are formed in the content discharge grooves 547, wherein first control protrusions 562 are formed on a valve fixing member 56, and wherein the second control protrusions 548 are formed outside the first control protrusions 562.

The outer container 10 is formed with a button 11 which is formed one side surface thereof with a latch protrusion 12. The outer container 10 is formed with a hinge which faces the button 12 and is hinge-coupled to an outer container lid 20. The outer container 10 contains the container body 30 therein.

The latch protrusion 12 extending from an upper portion of the button 11 is easily retracted by the pressing operation of a user, such that the button 11 may be separated from a hook 21 of the outer container lid 20.

The outer container lid 20 which covers an upper portion of the outer container 10 is hinge-coupled to the outer container 10 to open or close the outer container 10.

The hook 21 is formed at one side of the outer container lid 20, and has a protrusion shape corresponding to the latch protrusion 12 of the outer container 10.

In addition, a mirror 22 is provided on the inner side of the outer container lid 20 to enable easy makeup when making up.

The container body 30 is formed with an air hole 31 and includes a side surface having an inner wall 32 and an outer wall 33.

Air may be introduced into the air hole 31 and the contents stored the contents container 40 may be discharged smoothly.

An outer side wall 513 extending downwardly from the pump bottom plate 51 of the pump 50 is fixedly coupled between the inner and outer walls 32 and 33.

The content container 40 includes a latch sill 41 such that the content container 40 is installed in the container body 30.

The content container 40 contains contents and is formed of a thin material which is easily deformable. Specifically, the content container 40 may be formed of at least one of a vinyl material, a synthetic resin material, general rubber, elastomer, silicone rubber, and NBR rubber.

When the content container 40 stores contents, the contents may be impregnated into a separate sponge which is installed in the content container 40.

The contents container 40 may be formed through double injection molding with the container body 30. After forming the content container 40 and the container body 30 while being separated from, each other, the content container 40 and the container body 30 are assembled with each other.

The embodiment will be described based on the content container 40 and the container body 30 separated from each other.

The latch sill 41 of the content container is latched to the inner wall 32 of the container body 30.

The pump 50 is coupled to an upper portion of the content container 40 to discharge the contents stored in the content container 40.

The pump 50 includes the pump bottom plate 51 formed at a center thereof with a content inlet 511, the pump main body 52 installed on the pump bottom plate 51, the elastic member 53 installed between the pump bottom plate 51 and the pump main body 52, the distribution plate 54 coupled at the upper side of the pump main body 52 to be movable up or down and formed with the content outlet 542, the discharge valve 55 installed on the distribution plate 54, and the valve fixing member 56 for fixing the discharge valve 55.

The pump bottom plate 51 is formed at the center thereof with the content inlet 511 and laterally extends to cover upper portions of the container body 30 and the content container 40. The pump bottom plate 51 includes the inner and outer side walls 512 and 513 formed downwardly.

The contents stored in the contents container 40 are moved to the content temporary storage TR formed in the pump 50 through the content inlet 511.

The inside wall 512 is fitted into the inner wall 32 of the container main body 30 and the outside wall 513 is fitted between the inner wall 32 and the outer wall 33 formed in the container main body 30. The inside wall 512 and the outside wall 513 press the latch sill 41 of the content container 40 latch-coupled to the inner wall 32 of the container body 30, such that the latch sill 41 is prevented from being separated from the inner wall 32 of the container main body 30.

The pump main body 52 is mounted on the pump bottom plate 51.

The pump main body 52 mounted on the pump bottom plate 51 is formed at the center thereof with a pump body 521 having a jar shape.

The inside space of the pump body 521 is the content temporary storage TR in which the contents of the content container 40 remains after being sucked through the content inlet 511 of the pump bottom plate 51 until the contents are discharged through the content outlet. 542 of the distribution plate 54.

Since the pump main body 52 is required to be repeatedly folded and unfolded, the pump main body 52 must be formed of a material having excellent elasticity. Therefore, preferably, the pump main body 52 must have at least one of materials having excellent elasticity such as rubber, elastomer, silicone rubber, NBR rubber, polyethylene (PE), polypropylene, and the like.

A suction valve 523 connected to the inner low portion of the pump body 521 through a resilient piece 522 is formed to open or close the content inlet. 511 of the pump bottom plate 51.

It is preferable that the suction valve 523 is formed in an inverted-trapezoidal cone shape, which protrudes downwardly.

In addition, a low side extension piece 524 is formed at an outside of a lower portion of the pump body 521 and an upper side extension piece 525 is formed at an outside of an upper portion of the pump body 521.

The lower side extension piece 524 coupled to pump bottom plate 51 and the upper side extension piece 525 is fittingly coupled between a body pushing wheel 545 formed on the distribution plate 54 and a distribution elate side wall 546.

The elastic member is installed between the pump bottom plate 51 and the pump main body 52.

The elastic member 53 installed between the pump bottom plate 51 and the pump main body 52 elastically supports the pump bottom plate 51 and the pump main body 52. After the low side extension piece 524 of the pump main body 52 is coupled to the pump bottom plate 51, one end of the elastic member 53 is placed on the low side extension piece 524. After the upper side extension piece 525 of the pump main body 52 is coupled to the upper portion of the pump main body 52, one end of the upper side extension piece 525 is elastically supported by the upper side extension piece 525.

One side of the elastic member 53 elastically supports the pump bottom plate 51 and the lower side extension piece 524 of the pump main body 52 while the other side of the elastic member 53 supports the upper side extension piece 525 of the pump main body 52 Thereby supporting the elasticity.

For this reason, when the distribution plate 54 is pressed, while the distribution plate 54 and the upper side extension piece 525 of the pump main body 52 move down together, the pump body 521 of the pump main body 52 is folded, so that the volume of the temporary storage tank TR is reduced.

The elastic member 53 may be either a synthetic resin material or a metal material. Since the elastic member 53 is located outside the pump main body 52, the elastic member 53 does not make direct contact with the contents, so that the contents may be prevented from being contaminated due to chemical changes and the durability may be enhanced.

The distribution plate 54 is coupled at an upper side of the pump main body 52 to be movable up or down. A discharge valve protrusion wheel 543 is formed at the center of the distribution plate 54. The discharge outlet 542 is formed on a side surface of the discharge valve protrusion wheel 543. A valve installation space 541 is formed at the circumference of the discharge valve protrusion wheel 543.

The discharge valve 55 is coupled into the valve installation space 541.

A main body push protrusion wheel 545 is formed below the distribution plate 54. When the distribution plate 54 moves downwardly to press the pump 50, the main body push protrusion wheel 545 presses the pump body 521 formed in the pump main body 52 of the pump 50 so that the volume of the content temporary storage TR of the pump 50 may be reduced.

A distribution plate side wall 546 is formed outside the main body push protrusion wheel 545 while being spaced apart from the main body push protrusion wheel 545 by a predetermined interval.

The upper side extension piece 525 of the pump main body 52 is fittingly coupled between the main body push protrusion wheel 545 and the distribution plate side wall 546 such that the pump main body 52 is prevented from being separated from the distribution plate 54.

The distribution plate 54 is radially formed thereon with the content discharge grooves 547, and the second control protrusions 548 are formed in the content discharge grooves 547.

Since the content discharge grooves 547 are radially formed to uniformly discharge the contents to the whole of the discharge plate 60.

The second control protrusions 548 are formed in the content discharge grooves 547 to allow contents to flow into the content discharge grooves 547, such the flow of the contents is controlled to allow the contents to be uniformly discharged around the content discharge hole 61 to all directions.

The discharge valve 55 is installed into the valve installation space 541 of the distribution plate 54.

The discharge valve 55 is formed with a discharge valve wing 551 which opens or closes the content discharge hole 542 formed in the distribution plate 54.

An upper extension piece 552 is formed at an upper side of the discharge valve 55, and the valve fixing member 56 is coupled to the upper extension piece 552.

The valve fixing member 56 is coupled to the upper extension piece 552 of the discharge valve 55, and is under-cut coupled to the distribution plate 54 to fix the discharge valve 55.

The valve fixing member 56 is formed at the center thereof with the content discharge hole 561 and the first control protrusions 562 are formed outside the content discharge hole 561.

The first control protrusions 562 are radially formed corresponding to the second control protrusions 548 formed in the content discharge grooves 547 of the distribution plate 54.

The upper surface of the valve fixing member 56 is located on the same plane as the content discharge grooves 547 of the distribution plate 54 and the first control protrusions 562 are positioned inside the second control protrusions 548.

When the contents are discharged through the content discharge hole 561, the contents flow into the content discharge grooves 547 over the first and second control protrusions 562 and 548.

In this case, the first control protrusions 562 and the second control protrusions 548 control the flow rate of the contents so that the contents are uniformly discharged around the content discharge hole 61 of the discharge plate 60 in all directions.

The discharge plate 60 is coupled to the distribution plate 54 of the pump 50 and is radially provided with contents discharge holes 61.

The content discharge holes 61 are radially formed to correspond to the content discharge grooves 547, and the sizes of the content discharge holes 61 are formed to gradually become larger outwardly toward the outer side from the center portion.

When the contents are discharged through the content discharge holes 61, since the amount of the contents flowing into the content discharge grooves 547 is gradually reduced outwardly, the sizes of the content discharge holes 61 is increased, so that the amounts of the contents discharged through the content discharge holes 61 are uniform.

The assembling m hod and the using state of the gel foundation container with a pump according to one embodiment of the present invention will be described in detail as follows.

In order to assemble the gel foundation container with a pump according to an embodiment of the present invention, in the state that the outer container 10 and the outer container lid 20 are hinge-coupled to each other, the content main body 30 is installed inside the outer container 10 and the content container 40 is installed in the container main body 30.

After contents are poured into the content container 40 or the sponge (45) impregnated with the contents is installed into the content container 40, the pump 40 is assembled, which includes the pump bottom plate 51 formed with the content inlet 511, the pump main body 52 installed on the pump bottom plate 51, the elastic member 53 installed between the pump bottom plate 51 and the pump main body 52, the distribution plate 54 coupled at the upper side of the pump main body 52 to be movable up or down and formed with the content outlet 542, the discharge valve 55 installed on the distribution plate 54, and the valve fixing member 56 for fixing the discharge valve 55.

In this case, the distribution plate 54 is radially formed thereon with content discharge grooves 547, and the second control protrusions 548 are formed in the content discharge grooves 547. The valve fixing member 56 is formed at the center thereof with the content discharge hole 561. The first control protrusions 562 are formed outside the content discharge hole 561.

The first control protrusions 562 are radially formed corresponding to the second control protrusions 548 formed in the content discharge grooves 547 of the distribution plate 54. The upper surface of the valve fixing member 56 is located on the same plane as the content discharge grooves 547 of the distribution plate 54 and the first control protrusions 562 are positioned inside the second control protrusions 548.

Thereafter, the discharge plate 60 in which the content discharge holes 61 are radially formed is coupled to the distribution plate 54 of the pump 50, where the sizes of the content discharge holes 61 gradually become larger outwardly from the central portion thereof.

The pump 50 coupled with the discharge plate 60 is coupled to the container main body 30. The pump bottom plate 51 of the pump 50 laterally extends to cover the upper portion of the container main body 30 and the outer side wall 513 formed downwardly is fixedly coupled between the inner and outer walls 32 and 33 of the container main body 30, so that the assembly is completed.

In order to use the gel foundation container provided with the pump assembled by the above-described method, after opening the outer container lid 20, as shown in FIG. 6, the discharge plate 50 is pressed by using a puff P.

When the discharge plate 60 is pressed, the pump body 521 of the pump main body 52 is folded while the distribution plate 54 of the pump 50 is pressed so that the elastic member 53 is compressed. Thus, the volume of the content temporary storage TR is reduced to generate a discharge pressure in the content temporary storage TR, so that the contents push the discharge valve wing 51 of the discharge valve 55 tightly closed to the discharge valve protrusion wheel 543 of the distribution plate 54. Therefore, the contents are pushed out and discharged through the content outlet 542 of the distribution plate 54. In this case, while the suction valve 523 of the pump main body 52 is pushed by the discharge pressure of the contents temporary storage TR, the suction valve 523 presses the content inlet 511 of the pump bottom plate 51 to allow the content inlet. 511 to be closed.

As shown in FIG. 7, the contents discharged through the contents outlet 542 of the distribution plate 54 flow into the contents outlet grooves 547 over the first control protrusions 562 formed on the valve fixing member 56 and the second control protrusions 548 formed on the distribution plate 54.

There is an advantage that the first control protrusions 562 and the second control protrusions 548 control the flow rate of the contents so that the contents are uniformly discharged around the content discharge holes 61 of the discharge plate 60 in all directions.

The content discharge holes 61 of the discharge plate 60 are radially formed to correspond to the content discharge grooves 547, and the sizes of the content discharge holes 61 are formed to gradually become larger outwardly from the center portion thereof. When the contents are discharged through the content discharge holes 61, since the amount of the contents flowing into the content discharge grooves 547 is gradually reduced outwardly, the sizes of the content discharge holes 61 is increased, so that the amounts of the contents discharged through the content discharge holes 61 are uniform.

As described above, the gel foundation container with a pump described in this disclosure is an illustrative purpose only, and the present invention is not limited thereto. Thus, it should be understood that numerous other modifications and embodiments can be devised by those skilled in the art within the spirit and scope of the present invention and they will fall within the scope of the present invention.

DESCRIPTION OF REFERENCE NUMERAL

10: Outer container
11: Button
12: Latch protrusion
20: Outer container lid

21: Hook
22: Mirror
30: Container main body
31: Air hole
32: Inner wall
33: Outer wall
40: Content container
41: Latch sill
50: Pump
51: Pump bottom plate
52: Pump main body
53: Elastic member
54: Distribution plate
55: Discharge valve
56: Valve fixing member
60: Discharge plate
61: Content discharge hole

The invention claimed is:

1. A gel foundation container with a pump, which comprises an outer container (10) and an outer container lid (20) hinge-coupled to the outer container (10) so as to be opened or closed, the gel foundation container comprising:

a container body (30) installed inside the outer container (10);

a pump (50) coupled to an upper portion of the container body (30); and a discharge plate (60) coupled to an upper portion of the pump (50) and formed with content discharge holes (61), wherein a distribution plate (54) formed at an upper side of the pump (50) is radially formed thereon with content discharge grooves (547), second control protrusions (548) are formed in the content discharge grooves (547), first control protrusions (562) are formed on a valve fixing member (56) coupled to the distribution plate (54), and the second control protrusions (548) are formed outside the first control protrusions (562).

2. The gel foundation container of claim 1, further comprising a content container (40) installed in the container body (30).

3. The gel foundation container of claim 2, further comprising a sponge (45) installed in the content container (40).

4. The gel foundation container of claim 1, further comprising a latch sill (41) formed on the content container (40).

5. The gel foundation container of claim 1, wherein the pump (50) comprises:

a pump bottom plate (51) formed at a center thereof with a content inlet (511);

a pump main body (52) installed on the pump bottom plate (51);

an elastic member (53) located outside the pump main body (52);

the distribution plate (54) coupled at an upper side of the pump main body (52) such that the distribution plate (54) is movable up or down, and formed with a content outlet (542);

a discharge valve (55) installed on the distribution plate (54);

the valve fixing member (56) for fixing the discharge valve (55);

a pump body (521) formed at a center of the pump main body (52); and a suction valve (523) formed on an inner low portion of the pump body (521) and connected to an elastic piece (522).

6. The gel foundation container of claim 5, wherein the pump body (521) is formed on an outer low portion thereof with a low side extension piece (524) and on an outer upper portion thereof with an upper side extension piece (525).

7. The gel foundation container of claim 1, wherein a discharge valve protrusion wheel (543) is formed at a center of the distribution plate (54), a discharge outlet (542) is formed on a side surface of the discharge valve protrusion wheel (543), and a valve installation space (541) is formed about the discharge valve protrusion wheel (543).

8. The gel foundation container of claim 5, wherein the discharge valve (55) is formed with a discharge valve wing (551).

9. The gel foundation container of claim 1, wherein the valve fixing member (56) is formed at a center thereof with a content discharge hole (561).

10. The gel foundation container of claim 1, wherein sizes of the content discharge holes (61) of the discharge plate (60) gradually become larger outwardly from a center of the discharge plate (60).

* * * * *